US006453013B2

(12) United States Patent
Prins

(10) Patent No.: US 6,453,013 B2
(45) Date of Patent: Sep. 17, 2002

(54) X-RAY APPARATUS PROVIDED WITH A FILTER WITH A DYNAMICALLY ADJUSTABLE ABSORPTION

(75) Inventor: Menno Willem Jose Prins, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/833,484

(22) Filed: Apr. 12, 2001

(30) Foreign Application Priority Data

Apr. 17, 2000 (EP) ..... 00201372

(51) Int. Cl.[7] ..... G21K 3/00
(52) U.S. Cl. ..... 378/158; 378/156
(58) Field of Search ..... 378/156, 157, 378/158, 159

(56) References Cited

U.S. PATENT DOCUMENTS 5,625,665 A 4/1997 Fokkink et al. ..... 378/156
5,878,111 A * 3/1999 Schulz ..... 378/158
6,188,749 B1 * 2/2001 Schiller et al. ..... 378/157
6,198,806 B1 * 3/2001 Prins ..... 378/159
6,269,147 B1 * 7/2001 Powell ..... 378/146
2001/0022832 A1 * 9/2001 Prins et al. ..... 378/158
2001/0024486 A1 * 9/2001 Herbert ..... 378/158
2001/0043670 A1 * 11/2001 Prins ..... 378/157

FOREIGN PATENT DOCUMENTS

WO WO9938172 7/1999

* cited by examiner

*Primary Examiner*—Drew A. Dunn
(74) *Attorney, Agent, or Firm*—John Vodopia

(57) ABSTRACT

An X-ray apparatus is equipped with an X-ray filter having adjustable absorption properties in order to reduce the dynamic range of an X-ray image. The filter includes a matrix of filter elements 13, 13', 13" in which a level of an X-ray absorption liquid can be varied. The amount of the X-ray absorption liquid within an individual filter element determines the value of the X-ray absorption within this filter element. It is necessary that the resultant amount of the X-ray absorption liquid within each filter element is reproducible. Such an X-ray filter (12) is mounted near the X-ray source and is rotated together with the gantry when an X-ray image is required with some angulation with respect to an object. When the X-ray filter is angled (β) with respect to the vertical direction (g), the hydrostatic pressure within filter elements varies with respect to the calibrated state and the resultant amount of the X-ray absorption liquid is not reproducible. In order to compensate the variation of the hydrostatic pressure within the filter, the latter is provided with a hydrostatic pressure control system (131, 160).

9 Claims, 5 Drawing Sheets

X-RAY APPARATUS PROVIDED WITH A FILTER WITH A DYNAMICALLY ADJUSTABLE ABSORPTION

BACKGROUND OF THE INVENTION

1. Field of the Invention

The invention relates to an X-ray apparatus which is provided with an X-ray source for producing X-rays, an X-ray detector for detecting the X-rays, and a filter which is arranged between the X-ray source and the X-ray detector and includes a plurality of tubular filter elements for receiving an X-ray absorbing, electrically conductive liquid filling, first means being provided for applying an electric voltage to individual filter elements, an X-ray absorptivity of the individual filter elements being adjustable by control of a quantity of X-ray absorbing liquid filling present within the individual filter elements.

The invention also relates to a filter for use in the X-ray apparatus.

2. Description of Related Art

An X-ray apparatus of this kind is known from U.S. Pat. No 5,625,665 (PHN 15.044). The known X-ray apparatus includes a filter which includes a plurality of filter elements having an individual absorptivity, said absorptivities being dependent on a level of an X-ray absorbing and electrically conductive absorption liquid that is present within the filter element. The X-ray apparatus is used inter alia for medical diagnoses during which a patient to be examined is arranged between the X-ray source and the X-ray detector in order to image internal structures. Thanks to the fact that the patient has structures of different electron density, regions of different density are observed in a resultant X-ray image. The degree of difference in density between the regions of the extremes of the density in one X-ray image is defined as the dynamic range. The filter serves to limit the dynamic range per X-ray image.

In order to limit the dynamic range of the X-ray image, the known X-ray apparatus includes a filter with a matrix of filter elements for receiving an absorption liquid. The known filter consists of a matrix of filter elements, the filter elements being connected to a corresponding, common supply duct for the supply of an absorption liquid to the corresponding filter elements. The known apparatus utilizes the phenomenon that a contact angle between an electrically conductive liquid and an electrode that is isolated therefrom changes when a potential difference is applied between the electrically conductive liquid and the electrode. This phenomenon is known as electrowetting. In order to realize this intended functional property, each filter element is provided with a first electrode which is arranged in a wall of the filter element in order to apply an electric voltage to the wall of the filter element. A second electrode is in contact with the liquid filling. The known apparatus operates as follows: in the presence of a first value of the electric voltage (filling voltage) the adhesion of the liquid filling to the inner wall is increased so that the relevant filter element is filled with the liquid filling from the supply duct. In response to a second value of the electric voltage (drain voltage) the adhesion decreases and the liquid filling is drained from the filter element to the supply duct. Filter elements are adjusted to a high X-ray absorptivity by filling with the X-ray absorbing liquid filling; filter elements are adjusted to a low X-ray absorptivity by keeping them empty.

The mediocre reproducibility of the height of the column of the liquid filling constitutes a drawback of the known filter. The reproducibility of the height of the column of the liquid filling in a filter element is influenced by the intrinsic properties of a filter element, for example, by varying material properties of the filter element itself, and also by external factors, for example an orientation of the filter as a whole. It has been demonstrated that after a large number of electrical switching operations (more than 1000) a change occurs in the material properties of the first electrode in the filter element, which change is relevant to the height of the column of the liquid filling in the filter element.

Furthermore, the known filter is mounted on a gantry of the X-ray examination apparatus. It is known that the exposures of a patient take place while the gantry of the X-ray apparatus is in a rotated position; the gantry thus encloses different angles relative to the direction of the force of gravity. As a result of these rotated positions, changes occur in the hydrostatic pressure in the common liquid supply duct, which changes affect the reproducibility of the height of the column of the absorption liquid in the internal volume of the filter elements.

OBJECTS AND SUMMARY OF THE INVENTION

It is an object of the present invention to provide an X-ray apparatus in which the reproducibility of the height of the column of the liquid filling in the filter elements is ensured.

The X-ray apparatus in accordance with the invention is characterized in that the filter is also provided with a hydrostatic pressure control system for controlling a hydrostatic pressure in the filter elements, measuring means being provided for measuring a physical quantity related to the height of a column of the X-ray absorbing liquid filling within the filter elements, and with control means for controlling the hydrostatic pressure control system, the height of the column of the X-ray absorbing liquid filling in an individual filter element being determined by the combination of the hydrostatic pressure and the electric voltage applied to the filter element.

The filter in accordance with the invention is provided with a hydrostatic pressure control system in order to enable complete compensation of a change of the hydrostatic pressure in the common liquid supply duct due to a change of the orientation of the filter as a whole. A hydrostatic pressure control system is known per se from WO 99/38172. The hydrostatic pressure control system in the known device, however, serves a different purpose, that is, the addressing and filling of the filter elements with the X-ray absorbing liquid. The filter in accordance with the invention is also provided with second means which are arranged to measure a physical quantity that is related to the height of the column of the X-ray absorbing liquid filling within the filter elements. This step is taken so as to render the reproducibility of the height of the column of the X-ray absorbing liquid in a filter element independent of the secondary effects influencing the operation of the filter as a whole. Such secondary effects are, for example, a change of the physical properties of filter elements that is caused by the number of switches of the electric voltage applied to the first electrode, and also an orientation of the filter as a whole relative to the force of gravity. The influence of such secondary effects on the filter can be compensated by measuring a physical quantity that is related to these secondary effects. To this end, a first embodiment of the filter in accordance with the invention is characterized in that the measuring means are arranged to measure a reference electric voltage in at least one reference filter element. It has been demonstrated that a relationship exists between a resultant height of the column of the X-ray absorbing liquid in the filter element and the corresponding electric voltages applied to the filter element. In order to compensate the above-mentioned variation of the material properties, use is made of one or more reference elements that are representative of the entire system of filter elements. It is possible to select a filter element within the matrix of filter elements and to calibrate it so as to define a relationship between the electric voltage applied to the filter element and the resultant height of the column of the X-ray absorbing liquid in the filter element in a reference situation, for example, for a gantry angle amounting to zero degrees.

As the material properties of filter elements change, the relationship between the resultant column height of the liquid filling in the filter element and the electric voltage applied to the filter element and determined a priori also changes. This electric voltage is determined for a reference condition of the filter and is applied to all filter elements. The material ageing effect can be compensated by establishing this relationship anew in the course of time and by defining new filling and draining voltages. It is also possible to adapt the hydrostatic pressure in the system of filter elements by means of the pressure control system. The reproducibility of the column height of the liquid filling in the filter elements is thus ensured for the control of the filter elements by means of the a priori defined electric voltage.

This correction method can also be used for the orientation correction. The relationship between the resultant column height and the electric voltage is determined for a gantry angle other than zero degrees. The new draining and filling voltages resulting from such a measurement are defined and used for all filter elements for operation of the filter at this gantry angle. Not only the effect of the orientation of the filter as a whole can thus be compensated relative to the force of gravity, but also a cumulative effect of the ageing and orientation. As a result, the reproducible desired height of the column of the X-ray absorbing liquid in the system of filter elements can be attained for arbitrary gantry angles. A further embodiment of the filter in accordance with the invention is characterized in that the measuring means are arranged to measure a hydrostatic pressure in the common liquid supply duct. The variation of the hydrostatic pressure in the entire supply duct can be measured directly in order to compensate this variation subsequently by means of the hydrostatic pressure control system. The change of the hydrostatic pressure in the common liquid supply duct may be due to the changing of the orientation of the filter relative to the force of gravity. This change has an effect on the reproducibility of the column of the X-ray absorbing liquid in the filter elements. The filter in accordance with the invention is provided with third means which control the hydrostatic pressure control system in such a manner that the changes in the hydrostatic pressure in the liquid supply duct can be compensated. The reproducibility of the column height of the X-ray absorbing liquid in the filter elements is thus ensured. A further embodiment of the filter in accordance with the invention is characterized in that the measuring means are arranged to measure an orientation of the filter as a whole relative to a vertical direction. The gantry angle of the X-ray apparatus can be read out and subsequently data that are known a priori can be consulted so as to compensate the change of the hydrostatic pressure in the liquid supply duct that corresponds to this gantry angle. Such a priori known data can be derived, for example from a look-up table in which the necessary pressure corrections are stored as a function of the gantry angles. Presenting such data to the third means, for example by means of a separate correction program, enables the change of the hydrostatic pressure to be compensated and ensures the reproducibility of the desired height of the column of the X-ray absorbing liquid in the filter elements.

The operational object of the filter in accordance with the invention is, for example, to limit the dynamic range of the X-ray image. In order to fill the individual filter elements with the liquid filling, the filter includes a common liquid supply duct. The function of the liquid supply duct is to transport the liquid filling from and to the individual filter elements. The liquid supply duct is always filled with the liquid filling that influences the transmission of the X-rays. In order to enable suitable imaging of the regions in the object to be examined that have a high intrinsic absorption, it is desirable to limit the quantity of liquid filling in the common liquid supply duct. To this end, a further embodiment of the filter in accordance with the invention is characterized in that there is provided a liquid reservoir for the supply of the X-ray absorbing liquid via the common supply duct. The reservoir is connected to the filter and can be arranged outside the imaging region. The liquid filling that is drained from the individual filter elements is applied to the liquid reservoir via the liquid supply duct. This step enables the volume of the liquid supply duct to be minimized, so that the liquid filling present in the liquid supply duct has practically no effect on the quality of the resultant X-ray image.

For practical reasons it may be advantageous to manufacture the filter as one integrated object. To this end, a next embodiment of the filter in accordance with the invention is characterized in that the liquid reservoir is provided with tubular elements. When this step is taken the filter and the liquid reservoir are manufactured in one technological step and the tubular elements are integrated in the overall construction. The tubular elements are preferably situated at the periphery of the overall construction and perform the function of a liquid reservoir. The liquid filling that is drained from the filter elements is conducted to the tubular elements belonging to the liquid reservoir via the liquid supply duct. In the operating condition the tubular elements are situated outside the primary X-ray field and hence have no effect on the quality of the image.

A further embodiment of the filter in accordance with the invention is characterized in that the tubular elements are filter elements. The filter elements belonging to the liquid reservoir are thus provided with means for applying electric voltages to these filter elements.

A further embodiment of the filter in accordance with the invention is characterized in that the first means are arranged to drain the liquid filling from an internal volume of each filter element to at least one corresponding filter element in the liquid reservoir. The control logistics for the filter reveal that it may be advantageous to manufacture a filter in such a manner that each filter element has a corresponding filter element in the liquid reservoir, thus forming pairs of filter elements. This step enables electric control of the filter in such a manner that the liquid filling is transported between the pairs of filter elements. In order to realize this, for example, a drain electric voltage is applied to a filter element and a filling electric voltage is applied to a corresponding filter element of the liquid reservoir. The lowering of the column of the liquid filling in the filter element is thus succeeded by the raising of the column of the liquid filling in the corresponding filter element of the liquid reservoir. In order to reduce the number of electric circuits that is necessary for the transport of the liquid filling, a corresponding group of filter elements of the liquid reservoir can be designated for a group of filter elements. For example, in order to drain the liquid filling from the filter elements of a group of four filter elements to four filter elements of the liquid reservoir, a drain voltage is applied to the group of filter elements and a filling voltage is applied to a group of four filter elements of the liquid reservoir. In this case the internal volume of the filter elements of the liquid reservoir is filled completely with the liquid filling. In case one filter element of the group of four filter elements is to be drained, the corresponding filter elements of the liquid reservoir are filled for one quarter of their internal volume.

As has already been indicated, changes occur in the hydrostatic pressure in the filter as soon as the orientation of the filter as a whole is changed. The hydrostatic pressure control system is arranged to compensate such pressure variations by controlling the hydrostatic pressure in the filter elements. It has been found that the filter elements arranged at the extremities of the matrix of filter elements exhibit different effective pressure variations due to the variation of the height. In order to minimize such differences, the filter in accordance with the invention is characterized in that the filter includes a number of subfilters that are hydraulically separated from one another. An example of such a step is the subdivision of a filter into four quadrants, each quadrant constituting a hydraulically closed system with its own liquid supply duct and its own liquid reservoir.

These and other aspects of the invention will be described in detail hereinafter on the basis of the following embodiments and with reference to the associated drawing; therein

DETAILED DESCRIPTION OF THE PREFERRED EMBODIMENT

Figure 1:
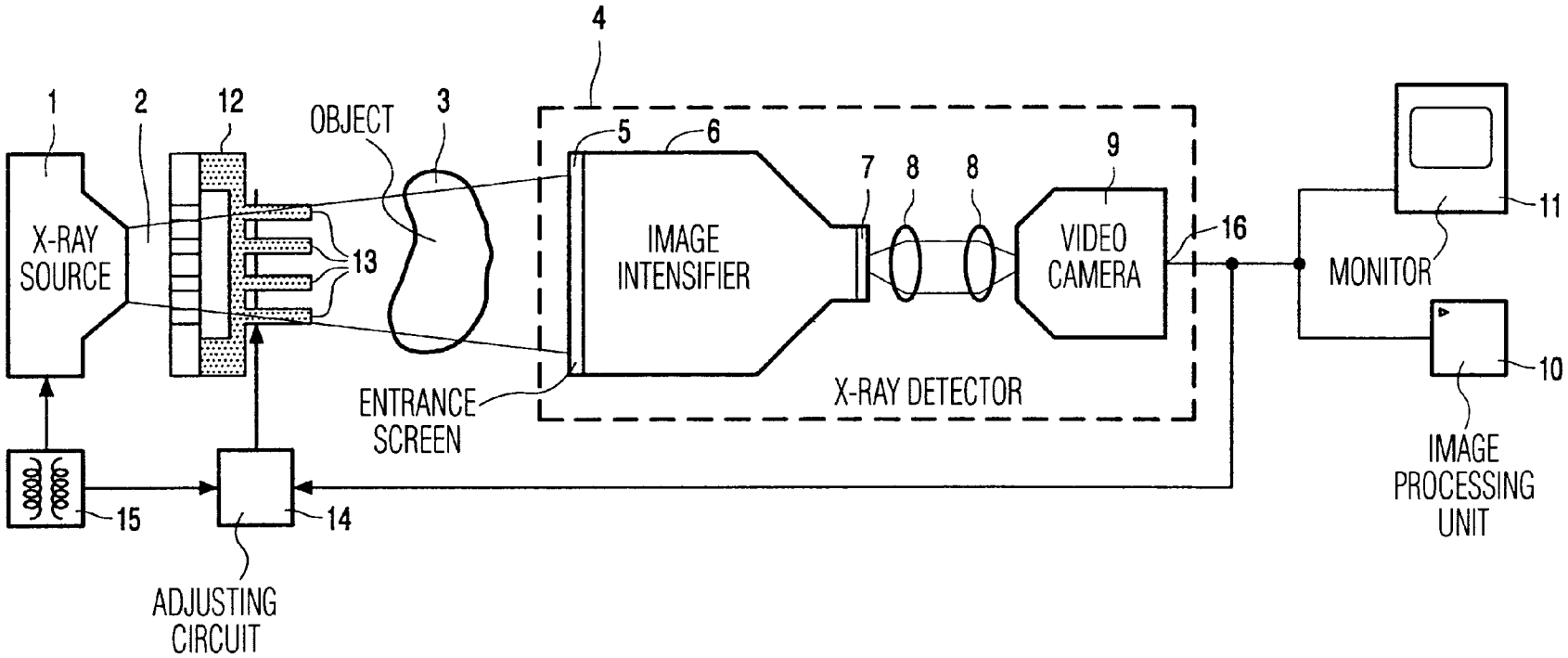
FIG. 1 is a diagrammatic view of an X-ray apparatus in accordance with the invention that is provided with a filter.

FIG. 1 shows diagrammatically an X-ray examination apparatus that includes a filter in accordance with the invention. The X-ray source 1 emits an X-ray beam 2 that irradiates an object 3, for example a patient, to be examined. As a result of local differences in the absorption of X-rays in the object 3 an X-ray image is formed on the X-ray detector 4, in this case being an image intensifier pick-up chain. The X-ray image is formed on the entrance screen 5 of the X-ray image intensifier 6 and is converted into a light image on the exit window 7, which light image is imaged on a video camera 9 by means of a lens system 8. The video camera 9 forms an electronic image signal from the light image. The electronic image signal is applied, for example for further processing, to an image processing unit 10 or to a monitor 11 on which the image information in the X-ray image is displayed.

Between the X-ray source 1 and the object 3 there is arranged a filter 12 for local attenuation of the X-ray beam 2. The filter 12 includes several tubular filter elements 13 whose X-ray absorptivity can be adjusted by application of electric voltages to the wall of the filter elements by means of an adjusting circuit 14. The electric voltages are adjusted, for example, on the basis of the setting of the X-ray source 1 by means of the power supply 15 of the X-ray source and/or on the basis of, for example, brightness values of the X-ray image that can be derived from the signal on the output terminal 16 of the video camera 9. The general construction of a filter 12 of this kind and the composition of the liquid filling are described in greater detail in United States patent U.S. Pat. No. 5,625,665 (PHN 15.044).

Figure 2A:
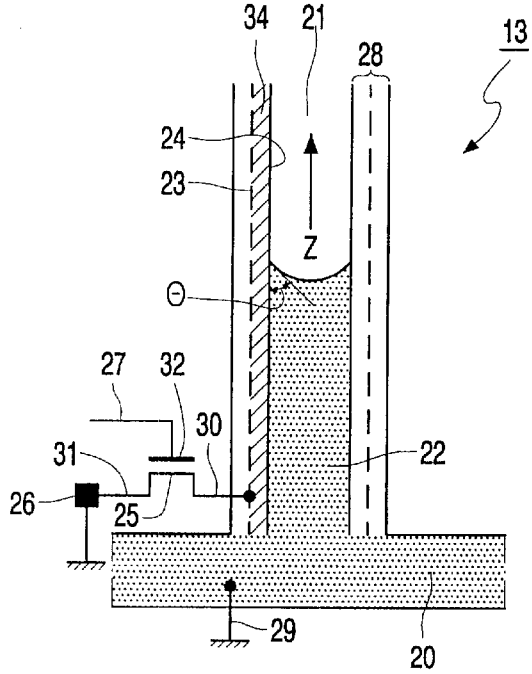
FIG. 2*a* is a diagrammatic sectional view of a filter element of the filter of FIG. 1 that is filled with a liquid filling composed of two liquid components that are fully miscible.

FIG. 2*a* is a diagrammatic sectional view of a tubular filter element 13 of a filter as shown in FIG. 1. The filter element 13 is filled, via the supply duct 20, with the liquid filling 22 which is electrically conductive and X-ray absorbing. For each filter element there is defined the longitudinal direction z as well as the internal volume 21 that is bounded by the walls 28 of the filter element. Each filter element includes a first electrode 23 in the form of an electrically conductive layer which is electrically isolated from the liquid filling 22 present in the internal volume 21, said isolation being realized by way of an isolator layer 34 and an inert cover layer 24 that is provided on an inner side of the walls 28, and also includes a second electrode 29 for applying an electric potential to the liquid filling. The first electrode 23 of the filter element 13 is coupled to a switching element which forms part of the first means for applying an electric voltage to an individual filter element. In the present example the switching element consists of a drain contact 30 of a field effect transistor 25 whose source contact 31 is coupled to a voltage line 26 that forms part of an electrical control device (not shown). The field effect transistor 25 is turned on, that is, the switching element is closed, by means of a control voltage that is applied to a gate contact 32 of the field effect transistor 25 via the control line 27. The electric voltage on the voltage line 26 is applied to the first electrode 23 by closing the switching element. When the voltage line is set to the value of the "filling" voltage, the contact angle O enclosed by the liquid filling 22 relative to the inert cover layer 24 decreases and the relevant filter element is filled with the liquid filling.

Figure 2B:
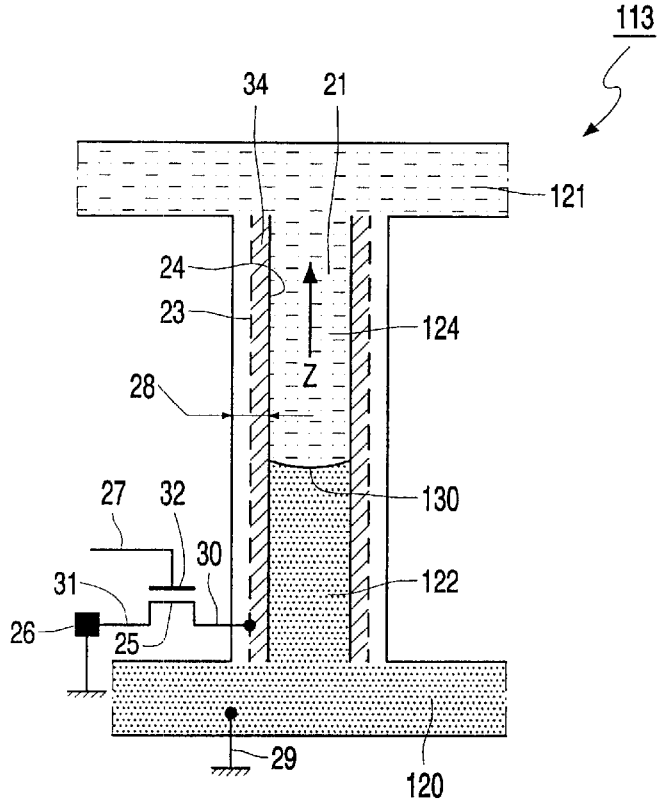
FIG. 2*b* is a diagrammatic sectional view of a filter element of the filter of FIG. 1 that is filled with a liquid filling composed of two liquid components that are not miscible.

FIG. 2*b* is a diagrammatic sectional view of the tubular filter element 113 of a filter as shown in FIG. 1 when the filter element is filled with the liquid filling that consists of an electrically conductive liquid component 122 and an X-ray absorbing liquid component 124. In this case the liquid components are not miscible. The liquid components are applied via respective supply ducts 120 and 121. The other functional parts of the filter element 113 are substantially the same as those of the filter element 13, so that the electric control circuits for the electrically conductive liquid component can be constructed in a similar manner. The control circuits determine the level of the electrically conductive liquid component 122 in the internal volume 21 of the filter element 113 which in its turn determines the level of the X-ray absorbing liquid component 124 in the filter element 113, because the respective components constitute one common liquid column with an interface 130. The degree of X-ray absorption is in this case determined by the degree of filling of the filter element 113 with the X-ray absorbing component 124.

Figure 3:
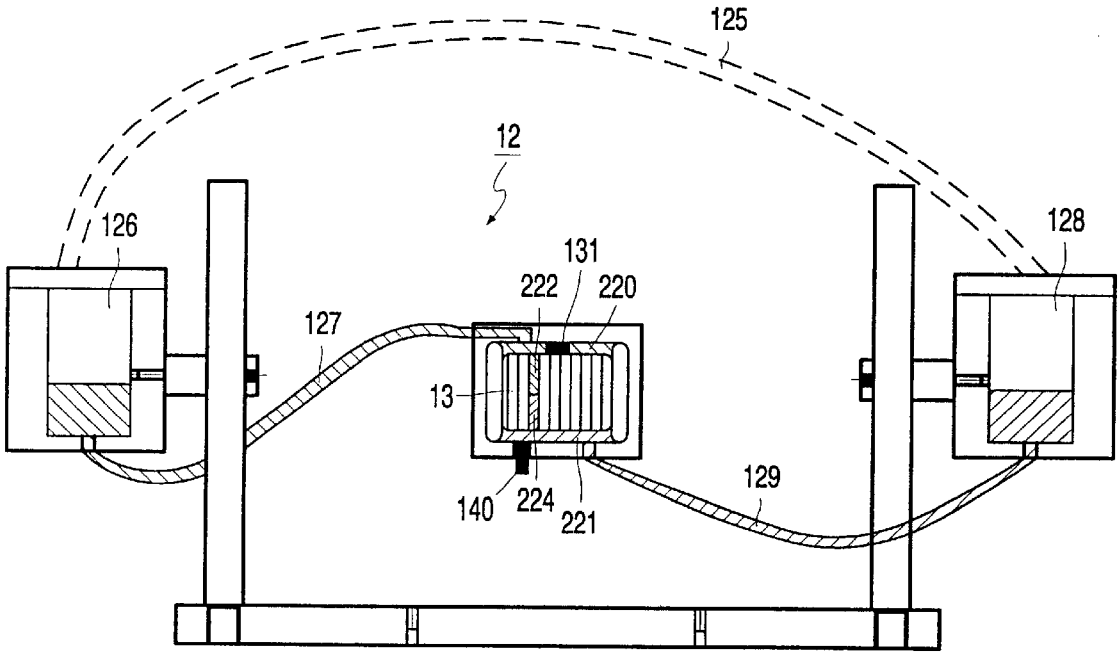
FIG. 3 shows diagrammatically the filter of FIG. 1 that is provided with ahydrostatic pressure meter.

FIG. 3 is a diagrammatic representation of a filter 12 in accordance with the invention in which the liquid filling comprises two liquid components 222, 224 that are not miscible, each liquid component being applied to the filter 22 from a respective liquid reservoir 126, 128. The filter 12 is provided with a hydrostatic pressure control system in the form of two liquid reservoirs. The positions of the liquid reservoirs 126, 128 relative to one another and to the filter 12 can be varied. The resultant hydrostatic pressure in the filter is thus determined. Each liquid component 222, 224 is applied to the matrix of filter elements via a flexible duct 127, 129 and a corresponding common supply duct 220, 221. In the present example the liquid reservoirs are shown as reservoirs that are isolated from one another (path 126, 13, 128). It is also possible to interconnect the liquid reservoirs 126, 128 by way of a tube 125 that is denoted by a dashed line. The function of the tube 125 is to create a system that is completely closed relative to the environment, so as to counteract evaporation of liquid. The assembly can be mounted in the head of an X-ray apparatus which is not shown in FIG. 3. A hydrostatic pressure in the system of filter elements is determined by the densities of the liquid components 222, 224 and by the heights of the liquid reservoirs 126, 128 relative to one another. For a given ratio of the densities of the liquid components a change in the hydrostatic pressure can be compensated by changing the heights of the liquid reservoirs. The filter is provided with measuring means in the form of a hydrostatic pressure meter 131 in order to measure the effect of the orientation of the filter 12 as a whole on the hydrostatic pressure in the filter elements 13 that is due to a rotation of the gantry of the X-ray apparatus. In the present example the hydrostatic pressure meter is arranged in the liquid supply duct 220, but it may also be arranged in a different location. It is also possible to provide two hydrostatic pressure meters, that is, one in the liquid supply duct 220 and the other in the liquid supply duct 221. The change of the hydrostatic pressure is thus measured across a meniscus that separates the liquid components 222 and 224 from one another. The filter 12 is calibrated for optimum operation in a reference position; a reference hydrostatic pressure corresponds thereto. As soon as the hydrostatic pressure meter 131 detects a deviation in the hydrostatic pressure, the height of a liquid reservoir is changed. In the present example this procedure involves the control of further control means (not shown) in the form of drive motors for the liquid reservoirs, the relative height of the liquid reservoirs thus being changed. In order to realize the desired rise of the liquid filling in a filter element, a given electric voltage is applied to the first electrode via an electrode 140. The degree of X-ray absorption is determined by the degree of filling of the filter element 13 with an X-ray absorbing liquid component.

Figure 4A:
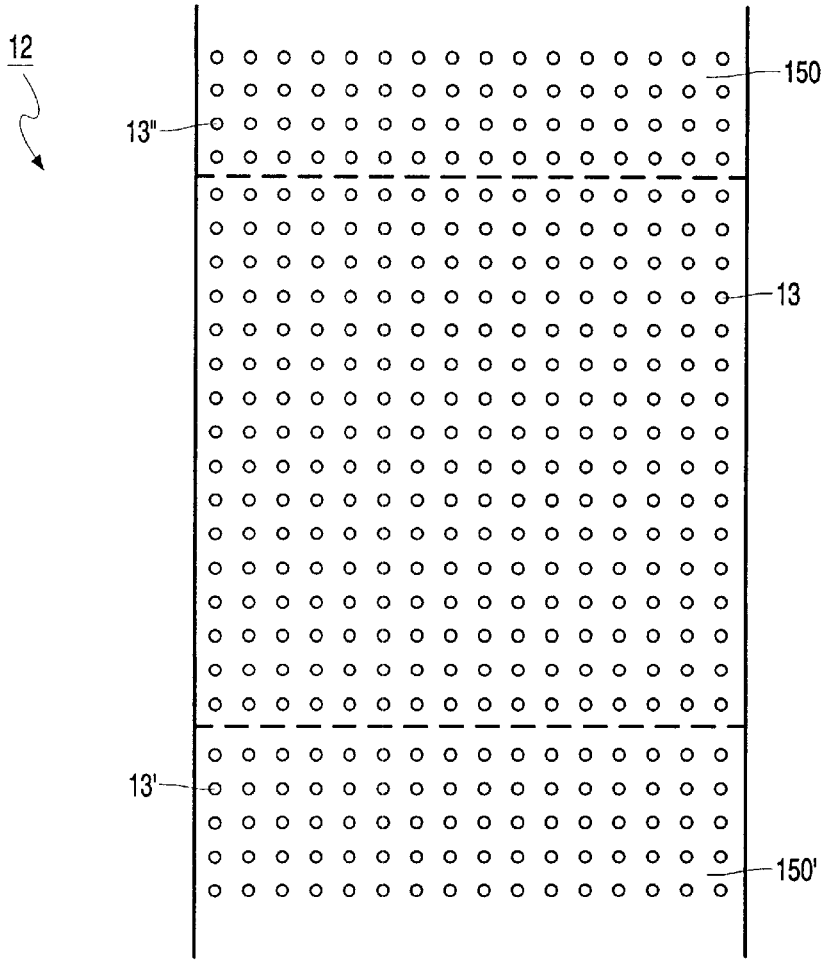
FIG. 4*a* shows diagrammatically the filter of FIG. 1 that is provided with an integrated liquid reservoir.
Figure 4B:
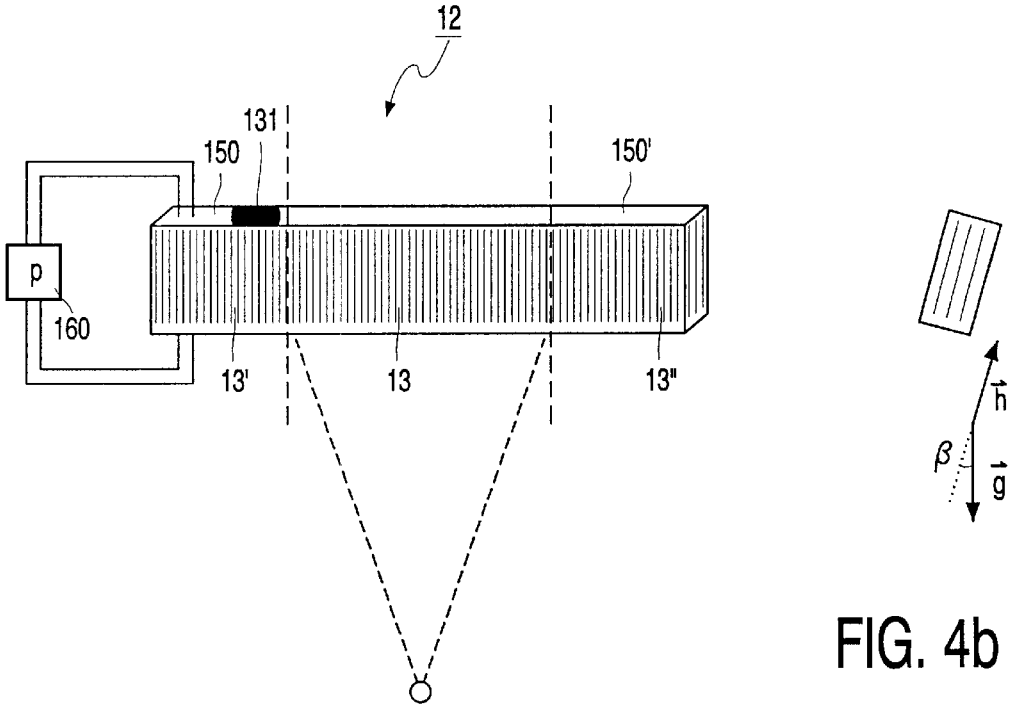
FIG. 4*b* shows the filter of FIG. 1 and a pump that is diagrammatically represented.

FIG. 4*a* is a diagrammatic sectional view of the filter 12 in accordance with the invention in which the liquid reservoir 150, 150' includes filter elements 13', 13". In this case the filter elements 13', 13", belonging to the reservoir volume, are situated in the periphery of the overall construction. In addition to a compact construction, there is the advantage that the use of integrated liquid reservoirs 150, 150' offers a reduction of the number of technological steps required for the manufacture of a filter of this type. In the case of an integrated liquid reservoir the filter is provided with the hydrostatic pressure control system in the form of an active pump 160 which keeps the hydrostatic pressure, measured by a hydrostatic pressure meter 131 at a given level as shown in FIG. 4*b*. FIG. 4*b* illustrates the case where the orientation of the filter as a whole (h) is moved through an angle (β) relative to the vertical direction (g). The associated changes in the hydrostatic pressure are measured by the measuring means 131 and are compensated by the hydrostatic pressure control system in the form of the active pump 160. A desired height of the column of the liquid filling is in this case also determined by an electric voltage applied to the first electrode of a filter element 13', 13" and by the hydrostatic pressure.

Figure 5:
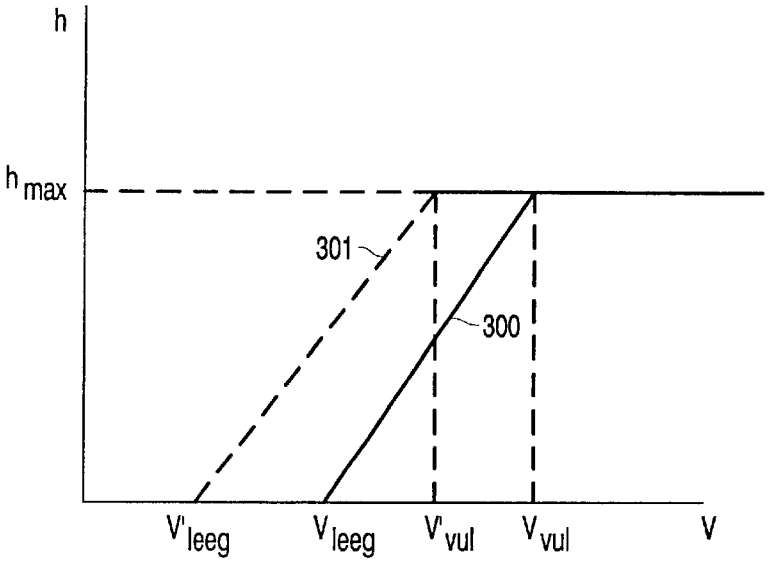
FIG. 5 shows diagrammatically a characteristic variation of the functional dependency of the height of the column of the liquid filling and an applied electric voltage.

It is known that the absolute value of the filling voltage, or the voltage corresponding to the maximum height of the liquid column in a filter element, is dependent on a hydrostatic pressure in the system of filter elements 13. FIG. 5 shows diagrammatically a variation of the curve of the height of the liquid column as a function of the electric voltage applied to the first electrode, which curve is referred to hereinafter as the h/V curve. A further embodiment of the filter in accordance with the invention utilizes measuring means in the form of a calibrated reference filter element which is arranged, for example, in one of the liquid reservoirs 126,128. The reference filter element is calibrated in respect of the reference hydrostatic pressure in the filter. The calibration curve 300 represents the variation of the height of the column of the liquid filling in the internal volume of the filter element as a function of the applied electric voltage. It follows from FIG. 5 that in the reference condition the height of the column of the liquid filling increases when the value of the electric voltage becomes higher than the drain voltage $V_{leeg}$, the maximum height of the column of the liquid filling being reached at the value of the electric filling voltage $V_{vul}$. In a condition of the filter that deviates from the reference condition, the hydrostatic pressure assumes a value that deviates from the reference value. FIG. 5 shows a deviating variation of the h/V curve 301. The change in the variation of the h/V curve in the reference filter element, for example as represented by the curve 301, is decisive in respect of the change of the hydrostatic pressure. This change can again be compensated by means of a hydrostatic pressure control system in the form of, for example, the active pump 160 (FIG. 4*b*).

Figure 6:
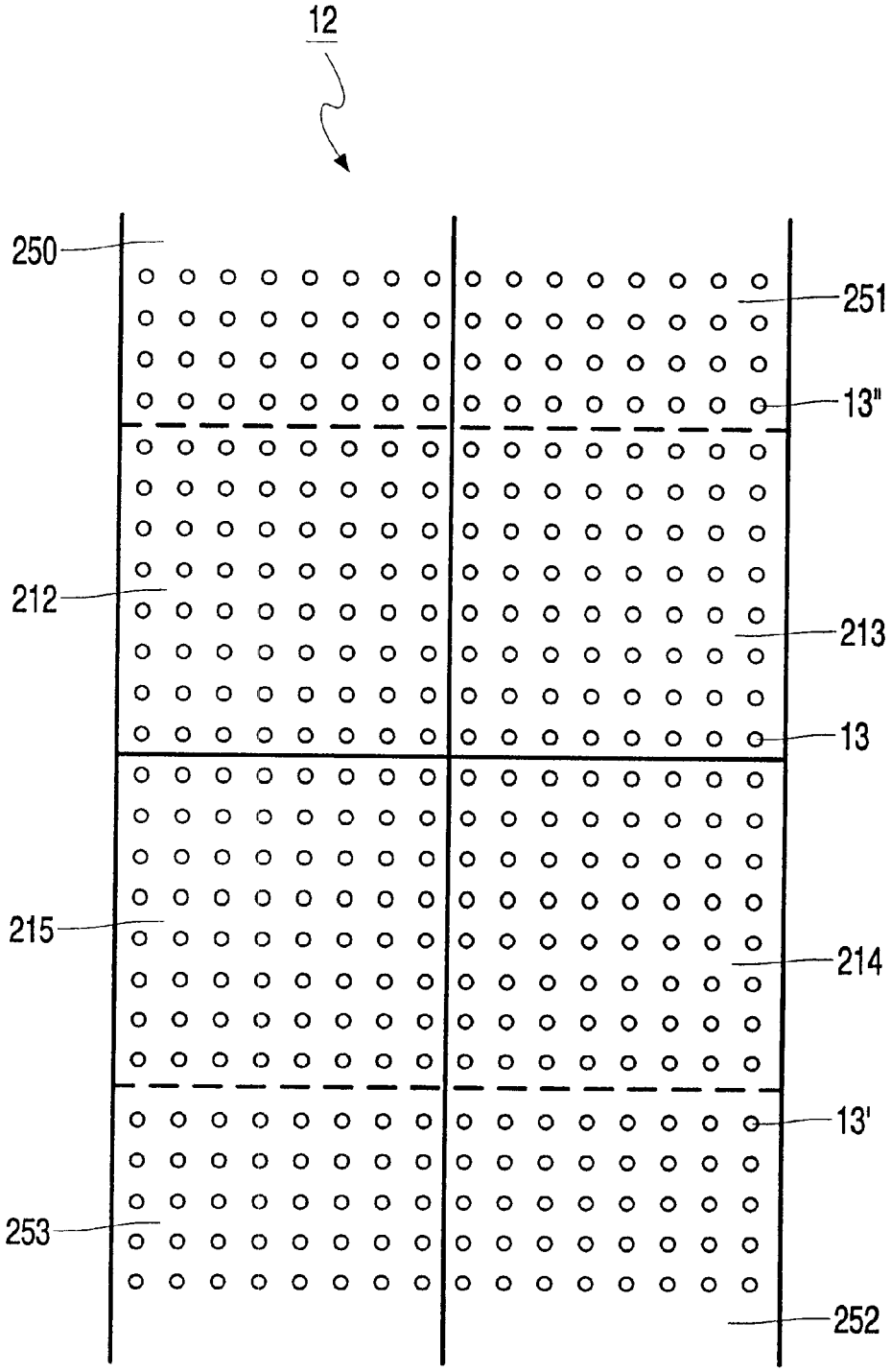
FIG. 6 shows the filter of FIG. 1 that includes a number of sub-filters that are hydraulically isolated from one another.

As will be evident to those skilled in the relevant art, in the case of a large matrix of filter elements a local variation will occur in the hydrostatic pressure for a rotated position of the filter. This variation can influence the reproducibility of the height of the column of the liquid filling. In order to limit such a variation, FIG. 6 illustrates diagrammatically a further embodiment of the filter in accordance with the invention in which the matrix of filter elements is subdivided into a number of hydrostatically isolated sub-filters 212, 213, 214, 215. Each sub-filter is connected to a corresponding liquid sub-reservoir 250, 251, 252, 253, said liquid sub-reservoirs being integrated with the system of sub-reservoirs in the present example. When the filter 12 is thus subdivided into sub-filters, a distance between two filter elements 13 that are situated furthest apart in the matrix is reduced and hence the local variation of the hydrostatic pressure is also reduced. In this case each sub-filter is provided with its own pump and its own hydrostatic pressure meter in conformity with the principle shown in FIG. 4.

What is claimed is:

1. An X-ray apparatus which is provided with an X-ray source (1) for producing X-rays (2), an X-ray detector (4) for detecting the X-rays, and a filter (12) which is arranged between the X-ray source and the X-ray detector and includes a plurality of tubular filter elements (13) for receiving an X-ray absorbing and electrically conductive liquid filling (22), first means (140) being provided for applying an electric voltage to individual filter elements (13), an X-ray absorptivity of the individual filter elements being adjustable by control of a quantity of X-ray absorbing liquid filling (22) present within the individual filter elements (13), characterized in that the filter (12) is also provided with a hydrostatic pressure control system (160) for controlling a hydrostatic pressure in the filter elements, measuring means being provided for measuring a physical quantity related to the height of a column of the X-ray absorbing liquid filling (224) within the filter elements, and with control means for controlling the hydrostatic pressure control system (160), the height of the column of the X-ray absorbing liquid filling (224) in an individual filter element being determined by the combination of the hydrostatic pressure and the electric voltage applied to the filter element.

2. A filter (12) for use in the X-ray apparatus claimed in claim 1, wherein the measuring means are arranged to measure a reference electric voltage (300, 301) in at least one reference filter element (135).

3. A filter (12) for use in the X-ray apparatus claimed in claim 1, wherein a common liquid supply duct (220, 221) is provided for all filter elements (13) and the measuring means are arranged to measure a hydrostatic pressure (131) in the common liquid supply duct (220).

4. A filter (12) for use in the X-ray apparatus as claimed in claim 1, wherein the measuring means are provided with means for measuring an orientation (β) of the filter as a whole relative to a vertical direction (g).

5. A filter (12) for use in the X-ray apparatus claimed in claim 1, wherein a common liquid duct (220, 221) is provided for all filter elements (13) and a liquid reservoir is provided for the supply of the X-ray absorbing liquid (224) via the common supply duct.

6. A filter (12) as claimed in claim 5, wherein the liquid reservoir (150, 150') includes tubular elements.

7. A filter (12) as claimed in claim 6, wherein the tubular elements are filter elements (13', 13").

8. A filter (12) as claimed in claim 7, wherein the first means are arranged to drain the liquid filling (22) from an internal volume of each filter element (13) to at least one corresponding filter element (13', 13") in the liquid reservoir (150, 150').

9. A filter (12) for use in the X-ray apparatus as claimed in claim 1, wherein the filter includes a number of sub-filters (212, 213, 214, 215) that are hydraulically separated from one another.

* * * * *